US006742314B2

(12) United States Patent
Young

(10) Patent No.: US 6,742,314 B2
(45) Date of Patent: Jun. 1, 2004

(54) WORKING POLES AND METHOD OF REPAIR

(76) Inventor: Robert A. Young, 1001 W. Kaler Dr., Phoenix, AZ (US) 85021

( * ) Notice: Subject to any disclaimer, the term of this patent is extended or adjusted under 35 U.S.C. 154(b) by 122 days.

(21) Appl. No.: 10/061,427

(22) Filed: Feb. 4, 2002

(65) Prior Publication Data

US 2003/0145554 A1 Aug. 7, 2003

(51) Int. Cl.[7] ..... E04C 3/30

(52) U.S. Cl. ..... 52/726.4; 52/736.1; 52/296; 52/741.14

(58) Field of Search ..... 52/296, 297, 741.14, 52/745.17, 726.1, 726.4, 736.1; 248/544, 545, 546

(56) References Cited

U.S. PATENT DOCUMENTS

| | | | | | |
|---|---|---|---|---|---|
| 3,564,804 | A | * | 2/1971 | Archer et al. | 52/745.17 |
| 4,242,851 | A | * | 1/1981 | Pohlman et al. | 52/726.3 |
| 4,312,162 | A | * | 1/1982 | Medney | 52/309.16 |
| 4,543,764 | A | * | 10/1985 | Kozikowski | 52/746.1 |
| 4,702,057 | A | * | 10/1987 | Phillips | 52/514 |
| 4,779,389 | A | * | 10/1988 | Landers | 52/169.13 |
| 4,785,593 | A | * | 11/1988 | Munoz, Jr. | 52/126.1 |
| 4,892,601 | A | * | 1/1990 | Norwood | 156/94 |
| 5,090,837 | A | * | 2/1992 | Mower | 403/334 |
| 5,513,477 | A | * | 5/1996 | Farber | 52/726.4 |
| 5,524,408 | A | * | 6/1996 | Richey | 52/514.5 |
| 6,287,042 | B1 | * | 9/2001 | Eriksson | 403/267 |
| 6,289,636 | B1 | * | 9/2001 | White et al. | 52/40 |

FOREIGN PATENT DOCUMENTS

| | | | |
|---|---|---|---|
| DE | 3721115 A1 | * | 1/1988 |
| FR | 429665 | * | 6/1935 |

* cited by examiner

*Primary Examiner*—Anita King
(74) *Attorney, Agent, or Firm*—Cahill, Sutton & Thomas P.L.C.

(57) ABSTRACT

A hollow working pole such as a luminaire pole is repaired by cutting the pole above ground level and inserting a sleeve. The sleeve is maintained in position while grout is poured to fill the space between the sleeve and the inner surfaces of the pole base. The top portion of the pole, previously removed, are replaced and grout is poured into the circumferential space between the insert and the inner surfaces of the upper portion of the pole.

11 Claims, 1 Drawing Sheet

WORKING POLES AND METHOD OF REPAIR

FIELD OF THE INVENTION

The present invention relates to a method and apparatus for repairing working poles such as luminaire poles, flag poles, utility poles and the like. More specifically, the invention is directed to those types of poles that are erected with the base portions thereof extending directly into the ground.

BACKGROUND OF THE INVENTION

Working poles such as luminaire poles are typically constructed of hollow pipe usually made of steel although aluminum, bronze or in some cases fiberglass are used. For several years cities and utility companies have utilized metal poles that are erected to a vertical position and are simply supported by drilling or excavating a hole in the ground, inserting the pole, and then compacting the soil around the base of the pole. While steel poles of the past have typically included an anti-corrosion surface such as asphaltic paint, the moisture in the soil through the years eventually penetrates the protective coating and causes corrosion of the metal. The length of time before such corrosion occurs varies depending on the climate, soil conditions, and of course the care with which the pole was erected; severe abrasion of the surface caused by rocky soils, scratching or gouging the surfaces of the pole causes penetration of the protective coating and permits more rapid access of moisture to the metal. The corrosion usually occurs near the surface of the ground or grade level where moisture accumulates and is held in the vicinity of or in contact with the base of the pole.

Over time the corrosion seriously degrades the strength of the pole rendering the pole unsafe or unable to withstand wind loads to which it is subjected. These poles are usually hollow and include electrical wiring extending upwardly from an underground conduit to the base of the pole, through the interior of the pole to luminaire equipment at the top thereof. When such corrosion occurs, it becomes incumbent upon the utility or municipal entity to replace the poles; such replacement is time consuming and very expensive. The expense and difficulty is exacerbated when concrete such as sidewalks or pavement exists around the base of the pole thus requiring removal and subsequent replacement of not only the pole but also the sidewalk or pavement.

OBJECTS OF THE INVENTION

It is therefore an object of the present invention to provide a method for repairing existing working poles.

It is another object of the present invention to provide a method for repairing an existing luminaire pole whose base is supported by the ground.

It is also an object of the present invention to provide an inexpensive means for repairing existing working poles that have been damaged by corrosion and that would otherwise require replacement.

It is still another object of the present invention to provide a corrosion resistant foundation for a corroded working pole.

It is still another object of the present invention to provide a working pole that has been repaired.

These and other objects of the present invention will become apparent to those skilled in the art as the description thereof proceeds.

BRIEF DESCRIPTION OF THE DRAWINGS

The present invention may more readily be described by reference to the accompanying drawings in which.

DETAILED DESCRIPTION OF THE PREFERRED EMBODIMENT

Figure 1:
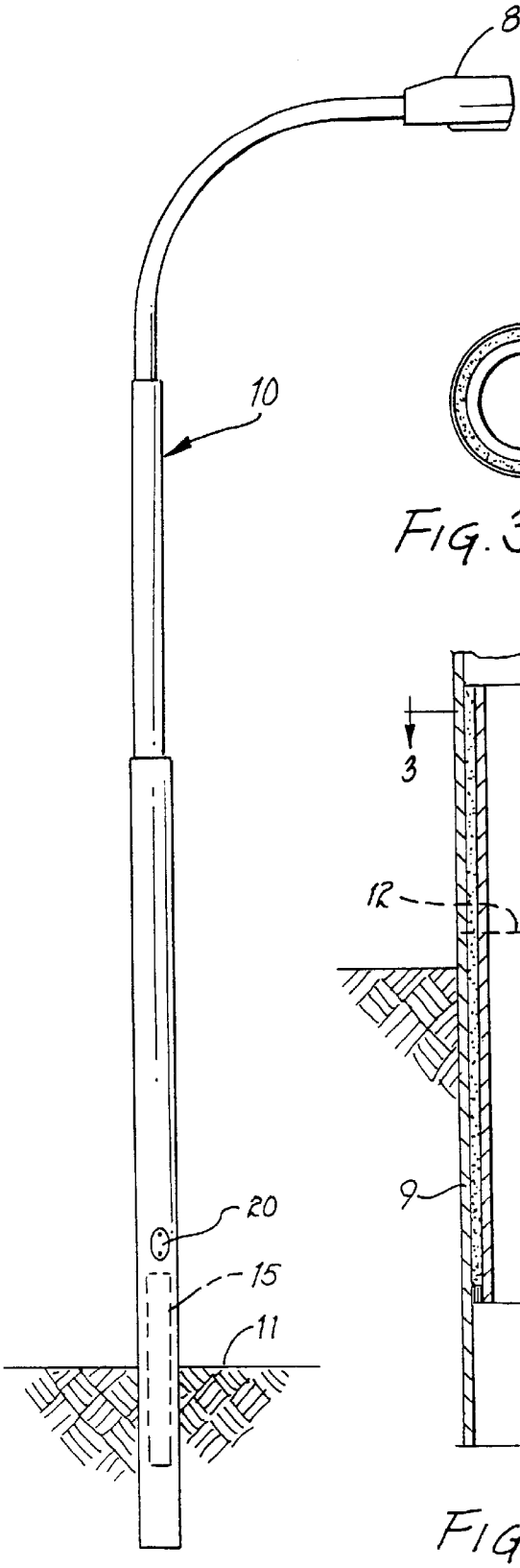
FIG. 1 is a side elevational view of a luminaire pole useful for describing the present invention.

Referring to FIG. 1, a luminaire pole 10 is shown extending into the ground through grade level 11. The luminaire pole is a type of working pole that is commonly found throughout the country and has been frequently erected by merely drilling a hole in the ground, inserting the base of the pole, and backfilling around the base and compacting the soil to maintain the pole in an essentially vertical position. The present invention is directed primarily to poles subjected to significant corrosion such as steel poles. Further, working poles could be considered flag poles, utility poles, light poles, or even poles utilized to support apparatus or equipment such as signs or displays and the like. In each instance, the invention is directed to those poles that are usually constructed of steel, are hollow, and are simply supported at their base by insertion into a hole in the ground and are therefore in intimate contact with soil at the base. As stated previously, these steel poles are usually provided with some type of corrosion coating in the form of paint, asphaltic paint, or even in some situations could be galvanized. The protection afforded by such coating of course is greatly reduced when abrasive soils (rocks, etc.) scratch or penetrate the protective coatings thus exposing the steel to moisture from the soil. Over the years, moisture accumulating at the surface adjacent the base of the pole causes corrosion and structural weakening.

The poles may take a variety of forms but are usually circular in cross-section, although some poles may be octagonal or polygonal. Further, the poles may be stepped cross-section such as that shown in FIG. 1 or may be a simple cylindrical form that is sometimes tapered as it approaches the top. Such poles usually include an inspection or utility opening 20 that is sometimes referred to as an "entry system". This utility opening is removable to permit access to the interior of the pole for the purpose of connecting electrical conductors extending from an underground conduit (not shown); these conductors are connected to corresponding conductors that extend through the interior of the hollow pole to a lamp or luminaire system 8 at the top of the pole. While the pole, when new, may be adequately supported through the extension of its base 9 below grade 11, the effects of corrosion generally in the area of the surface of the grade 11 at the base 9 results in corrosion of the metal of the pole as described above. This corrosion can occur even though a concrete or paved surface is placed on top of the grade 11. In those instances where the pole extends through concrete such as at a sidewalk or pavement, the corrosion nevertheless occurs and the replacement of the pole becomes even more complicated and expensive since the concrete will have to be removed and replaced when the pole is replaced.

Figure 2:
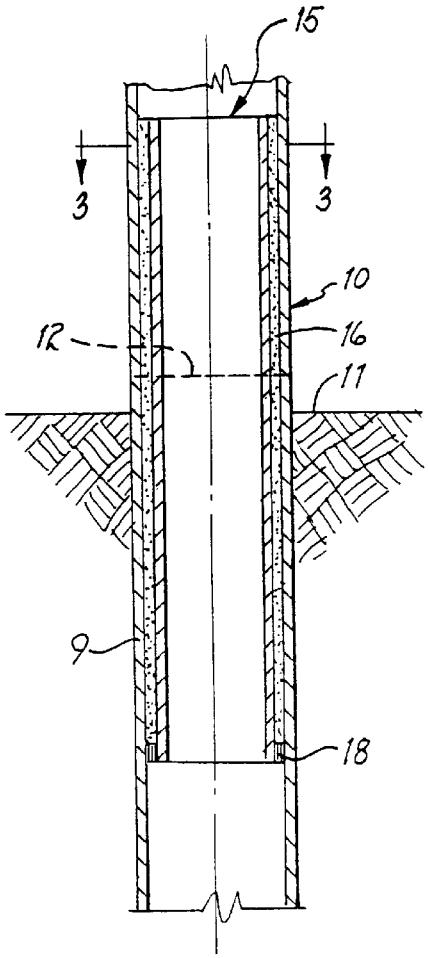
FIG. 2 is a cross-sectional view if a portion of the pole of FIG. 1 showing the base of the pole extending from the ground and showing the structure of a repaired pole constructed in accordance with the teachings of the present invention.
Figure 3:
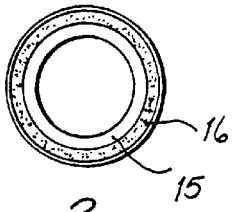
FIG. 3 is a cross-sectional view of the structure of FIG. 2 taken along line 3—3.

Referring now to FIG. 2, the base 9 of the pole shown in FIG. 1 extends below grade 11 and is shown in section. The method of the present invention includes cutting the pole above grade at its base at a position such as that shown at the cut 12. This cut or cutting may be accomplished through the use of a simple band saw or other type of saw. Under certain circumstances, the cut may be performed using a torch; in each instance, whether a saw or a torch is used, if the pole is electrified (that is, it includes electrical conductors extending therethrough), care must be taken not to cut the electrical conductors. In most instances, the utility opening 20 may be used to access the interior of the pole to disconnect the electrical conductors at the typical plug-type connectors joining those conductors extending upwardly through the base of the pole to the conductors extending to the top of the pole. Thus, care must be taken not to sever these wires since they will have to be reconnected when the pole is returned to service.

After cutting the pole as described above, the top of the pole including the now disconnected electrical conductors, and the light or luminaire apparatus on the top thereof are removed; an internal sleeve 15 formed of a metal pipe having a smaller diameter then the diameter of the pole is inserted in the base 9 of the pole to an appropriate depth and is centered in the base and maintained in position in a manner to be described. The sleeve 15 is provided with a spacer or grommet 18 that assists in positioning the sleeve in the base of the pole and also closes the circumferential gap existing between the sleeve and the pole base. When the sleeve is held in this position, packing material such as liquid grout 16 is poured into the space between the sleeve and the pole base. The grout is allowed to set. The top portion of the pole is then replaced over the sleeve into contact with the base from which it had been removed. Where a utility opening is not available, holes can be drilled through which grout is inserted. Grout is then poured through the utility opening 20 into the space between the sleeve and the pole that extends from the cut 12 to the top of the sleeve. When the grout sets, the pole is now in its original position and is vertically supported through its base from which it had previously been separated and is supported both vertically as well as in all load directions through the utilization of the grout and the internal sleeve. Packing material such as grout solidifies or stabilizes and can therefore transfer forces to and from the sleeve and the pole. Under some circumstances even sand may fulfil the requirements of the packing material. Such material conveniently may be poured into the circumferential space between the sleeve and the base and between the sleeve and the upper portion of the pole and subsequently "set"; alternatively, the material could be pre-formed and placed about the sleeve and subsequently activated after the sleeve is inserted in the base. It is important that the packing material be capable of withstanding the forces applied to it by the pole and the sleeve, and that it remains stable without shrinking over time.

Thus, the method of the present invention includes the cutting of the pole at its base above its ground support and then inserting and positioning a sleeve within the base, pouring grout to fill the space between the sleeve and the base, replacing the top portion of the pole to its original position in contact with its base, and pouring grout between the sleeve and the top portion of the pole. When the grout sets, the pole is in its original position and is strengthened and capable of withstanding all loads for which it was designed. Further, since the grout extends around the external surfaces of the internal sleeve, it serves to protect the sleeve from corrosion which therefore provides the pole with a corrosion resistant base. In addition, the sleeve can be galvanized to further increase its resistance to corrosion.

Figure 4:
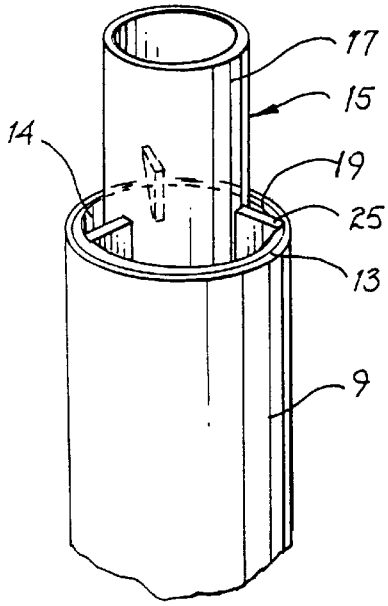
FIG. 4 is an isometric view of a portion of the pole of FIG. 2, partly in section, showing the utilization of wedges for centering an inner sleeve in the base of an existing pole.
Figure 5:
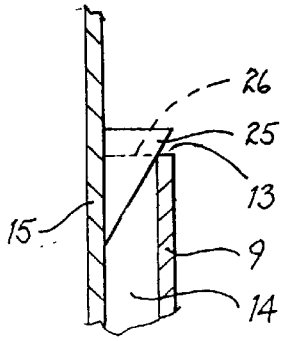
FIG. 5 is an enlarged view, partly in section, of a portion of FIG. 4 showing greater detail of the wedges of FIG. 4.

Referring now to FIG. 4, the exposed edge 13 of the base 9 may be seen while the sleeve 15 is shown extending upwardly from the base. To assist in centering the sleeve 15 within the base 9, wedges 25 may be placed about the sleeve and forced into the circumferential space 14 separating the external surface 17 of the sleeve 15 and the internal surface 19 of the base 9. One of these wedges is shown in greater detail in FIG. 5. It may be seen by using such wedges equally spaced about the external surface 17 of the sleeve 15 (three wedges positioned 120° apart) the sleeve may be positioned and maintained precisely concentrically within the base 9 to provide a uniform circumferential space 14 about the entire periphery of the sleeve 15. When the grout has been poured into the circumferential space 14, the wedges 25 may be removed or alternatively, the tops of the wedges may be cut as shown by the broken line 26 in FIG. 5 so that the remaining wedge tops correspond to the exposed edge 13 of the base 9. In this manner, when the top of the pole is replaced and positioned over the sleeve 15, and abuts the exposed edge 13 of the base 9, the wedges will not interfere with the accurate positioning of the top.

When the top of the pole has been replaced on its base, no further procedure is required and the resulting pole has been repaired by structural reinforcement to return its strength to the level necessary for design loads including wind loads. Further, the resulting repaired pole is cosmetically the same as it existed prior to the repair; that is, only the cut that had been made to separate the top and the base of the pole is evident. The electrical conductors that had previously been disconnected, can now be reconnected in a conventional manner by entrance to the interior of the pole through the utility opening.

The spacer or grommet 18 may be formed in any convenient manner and is required only to seal the circumferential space 14 against substantial leakage of moist grout as it is placed in the space. It has been found that this grommet can readily be formed by using commercially available foam rubber strips having an adhesive backing. The strip is wound about the lower edge of sleeve 15; the adhesively backed foam rubber strip can be wound about the sleeve to a depth sufficient to fill the circumferential space 14. Since the strip is formed of readily compressible foam, it can be wound about the sleeve to a diameter slightly larger than the internal diameter of base 9 of the pole. The grommet 18 can thus be slightly compressed as it is forced into the interior of the base 9 and positioned as shown in FIG. 2.

The grout that is used in the present invention may be typical standard non-shrink grout. It is believed that grout conforming to ASTM 1107 would be appropriate, such grout is low viscosity when initially mixed and is readily pourable into the space between the sleeve and the pole; the grout, when set, bonds to the external surfaces of the sleeve as well as the internal surfaces of the pole thus creating a strong joint structure connecting the pole to its base in the repaired pole. As described previously, the internal sleeve may be chosen from a pipe having the same strength or stronger than the pole and generally is chosen to be the largest diameter possible that will fit within the existing pole while leaving an adequate grout space therebetween; the space that has been found appropriate is generally approximately ½". The length of the sleeve must be sufficient to provide appropriate structural strength to the repaired pole; it is believed that the sleeve should extend into the base a distance of approximately 3 diameters of the pole and an equal distance into the upper portion of the pole. However, it is believed that a significantly shorter length may be adequate in many circumstances and may be as short as twice the diameter of the pole extending into the base and extending into the upper portion for the pole.

In those instances wherein corrosion exists in the base of the pole as it extends further into the ground from the grade level, it may be desirable to extend the lower portion of the sleeve further into the base of the pole. It may even be appropriate under circumstances encountering severe corrosion to extend the sleeve entirely into the base to the bottom of the hole which had previously been dug to receive the pole. In this manner, when grout is poured into the circumferential space surrounding the sleeve, the grout will extend all the way from the bottom of the hole up past the cut to the top of the sleeve. When this type of repair is undertaken, the grout and sleeve provide substantially greater structural improvement to compensate for the effects of corrosion on the portion of the pole base extending the deepest into the earth.

EXAMPLE

A luminaire pole was repaired by entering the utility opening therein and unplugging the electrical wires extending upwardly through the luminaire pole to the top thereof. A band saw was then used to cut through the base of the pole approximately 2" above grade level. The top of the pole was then removed leaving the base of the pole extending upwardly from the ground. The pole was formed of steel pipe of a typical 5" nominal OD (5.563") conforming to a typical ASTM A53 specification found in older luminaire poles. The pole had an asphaltic paint on it, the pipe had a nominal 3/16" thickness. A sleeve was chosen having a 4½" outside diameter and a wall thickness of 0.237". The chosen sleeve was cut to a length of 34 inches. A gasket formed of a foam rubber strip having an adhesive backing and being 1¼" wide and ⅛" thick was wound about the sleeve adjacent one end thereof until the thickness of the gasket formed thereby was slightly larger than the inside diameter of the base of the pole. The sleeve was then lowered into the base of the pole to a depth of about 17" measured from the exposed cut edge of the base or approximately one half its length. The sleeve was maintained in this position by three wooden wedges positioned 120° about the circumference of the sleeve and wedged between the sleeve and the pipe base. Grout was then poured to fill the circumferential space separating the sleeve and the pipe base; before the grout was fully set, the tops of the wooden wedges were cut level with the grout and exposed edge of the pole base. The upper portion of the pole was replaced on the base in contact with the exposed edge of the pole base. The pole was supported and plumbed in this position while grout was poured through the utility opening to fill the circumferential space separating the sleeve and the pole with grout. The grout was permitted to set, and the electrical conductors were reconnected. The resulting repaired luminaire pole exhibited sufficient structural strength to comport with its original design requirements. The pole was also provided with a corrosion resistant support through utilization of the insert that was shielded from intrusion and contact with moisture from the ground by the pole's outer surface and intervening grout material.

In some instances it was found useful to support the insert during the pouring of the grout to prevent the insert from slipping further into the base. The support is in addition to the support provided by the above described wedges and may be provided in any convenient manner. It was found that the utilization of a large C-clamp clamped across the diameter of the insert with the clamp in contact with the exposed edge of the base provided sufficient additional support to permit the grout to be poured and set; the C-clamp was positioned carefully so that it did not contact or interfere with the wedges.

The present invention has been described in terms of selected specific embodiments of the apparatus and method incorporating details to facilitate the understanding of the principles of construction and operation of the invention. Such reference herein to a specific embodiment and details thereof is not intended to limit the scope of the claims appended hereto. It will be apparent to those skilled in the art that modifications may be made in the embodiments chosen for illustration without departing from the spirit and scope of the invention.

What is claimed is:

1. A method for repairing a hollow working pole having an upper portion and a base extending vertically from a support comprising the steps:

(a) cutting said pole at its base above said support;

(b) removing the upper portion of the pole while leaving the base extending into the support;

(c) inserting a sleeve into the base to form a space between the sleeve and the base;

(d) filling said space with packing material;

(e) placing the upper portion of the pole over the sleeve to form a space between the sleeve and said upper portion; and (f) filling the space between the sleeve and said upper portion with said packing material.

2. The method of claim 1 wherein said packing material is grout.

3. A method for repairing a hollow working pole having an upper portion and a base extending vertically from a support comprising the steps:

(a) cutting said pole at its base above said support;

(b) removing the upper portion of said pole while leaving the base extending into said support;

(c) inserting a sleeve, having a predetermined length, approximately one half said length into the base to form a space between the sleeve and the base and to leave another half of said length exposed;

(d) filling said space with packing material;

(e) placing the upper portion of the pole over the exposed half of said length to form a space between the sleeve and said upper portion; and (f) filling the space between the sleeve and said upper portion with packing material.

4. The method of claim 3 wherein said packing material is grout.

5. A method for repairing a hollow working pole having an upper portion and a base extending from a support and having electrical conductors extending internally of said pole from said base to said upper portion comprising the steps:

(a) disconnecting the electrical conductors;

(b) cuffing said pole at its base above said support;

(c) removing the upper portion of the pole while leaving the base extending into the support;

(d) inserting a sleeve, having a predetermined length, approximately halfway into the base to form a space between the sleeve and the base and to leave half of said length exposed;

(e) supporting said sleeve in said base while filling said space with grout;

(f) placing the upper portion of the pole over the exposed half of said length to form a space between the sleeve and said upper portion;

(g) supporting said upper portion while filling the space between the sleeve and said upper portion with grout; and (h) reconnecting said electrical conductors.

6. A method for repairing a hollow working pole having an upper portion and a base extending from a support and having electrical conductors extending internally of said pole from said base to said upper portion comprising the steps:

(a) disconnecting the electrical conductors;

(b) cutting said pole at its base above said support;

(c) removing the upper portion of the pole while leaving the base extending into the support;

(d) inserting a sleeve, having a predetermined length, into the base to form a space between the sleeve and the base and to leave a portion of said sleeve of said length exposed;

(e) supporting said sleeve in said base while filling said space with grout;

(f) placing the upper portion of the pole over the exposed portion of said sleeve to form a space between the sleeve and said upper portion;

(g) supporting said upper portion while filling the space between the sleeve and said upper portion with grow; and (h) reconnecting said electrical conductors.

7. A hollow working pole comprising:

(a) a base extending substantially vertically from a support below grade;

(b) an upper portion extending above grade from said base;

(c) a cut separating said upper portion and base above said support;

(d) a sleeve having a predetermined length positioned within said hollow pole and extending from below grade to above said cut above grade and defining a space between said sleeve and an internal surface of said hollow pole; and (e) packing material positioned within said space.

8. The hollow working pole set forth in claim 7 wherein said packing material is grout.

9. The hollow working pole set forth in claim 7 wherein half of said predetermined length is below and half of said predetermined length is above said cut.

10. A hollow working pole comprising:

(a) a base extending substantially vertically from a support;

(b) an upper portion extending from said base;

(c) a cut separating said upper portion and base above said support;

(d) electrical conductors extending through said hollow pole from said base through said upper portion;

(e) a sleeve having a predetermined length positioned within said hollow pole and extending from below to above said cut and forming a circumferential space between said sleeve and an internal surface of said hollow pole; and (f) grout positioned in said circumferential space.

11. The hollow working pole set forth in claim 10 wherein half of said predetermined length is below and half of said predetermined length is above said cut.

* * * * *